US009244372B2

(12) United States Patent
Takamiya et al.

(10) Patent No.: US 9,244,372 B2
(45) Date of Patent: Jan. 26, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yuki Takamiya, Kanagawa (JP); Eisuke Iwazaki, Kanagawa (JP); Shuji Sato, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/254,417

(22) Filed: Apr. 16, 2014

(65) Prior Publication Data

US 2015/0111139 A1 Apr. 23, 2015

(30) Foreign Application Priority Data

Oct. 21, 2013 (JP) ..... 2013-218648

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 9/083*** | (2006.01) |

(52) U.S. Cl.

CPC ..... *G03G 9/08711* (2013.01); *G03G 9/0819* (2013.01); *G03G 9/0833* (2013.01)

(58) Field of Classification Search

CPC ..... G03G 9/097; G03G 9/09733; G03G 9/10; G03G 9/107

See application file for complete search history.

(56) References Cited

U.S. PATENT DOCUMENTS

| | | | | |
|---|---|---|---|---|
| 2006/0204282 | A1* | 9/2006 | Yoshida | G03G 15/0877 399/254 |
| 2009/0291381 | A1* | 11/2009 | Hirose | G03G 9/0914 430/108.21 |
| 2010/0248112 | A1* | 9/2010 | Fukushima | G03G 9/08755 430/105 |

FOREIGN PATENT DOCUMENTS

| | | |
|---|---|---|
| JP | A-63-061263 | 3/1988 |
| JP | A-02-110572 | 4/1990 |
| JP | A-2005-316141 | 11/2005 |
| JP | A-2010-085841 | 4/2010 |
| JP | A-2010-231081 | 10/2010 |
| JP | A-2011-112840 | 6/2011 |

* cited by examiner

*Primary Examiner* — Hoa V Le

(74) *Attorney, Agent, or Firm* — Oliff PLC

(57) ABSTRACT

An electrostatic charge image developing toner includes a binder resin, toner particles containing an acylglycerol, and an external additive, wherein at least one of hydroxyl groups in the acylglycerol is esterified with an alkyl monocarboxylic acid that contains a substituted or unsubstituted alkyl group having from 12 to 22 carbon atoms, and a content of a portion esterified with the alkyl monocarboxylic acid that contains the alkyl group having the same carbon number is 95 % by weight or greater with respect to the total weight of the acylglycerol.

18 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-218648 filed Oct. 21, 2013.

BACKGROUND

Technical Field

The present invention relates to an electrostatic charge image developing toner, an electrostatic charge image developer, and a toner cartridge.

SUMMARY

According to an aspect of the invention, there is provided an electrostatic charge image developing toner including:

a binder resin;

toner particles containing an acylglycerol; and an external additive, wherein at least one of hydroxyl groups in the acylglycerol is esterified with an alkyl monocarboxylic acid that contains a substituted or unsubstituted alkyl group having from 12 to 22 carbon atoms, and a content of a portion esterified with the alkyl monocarboxylic acid that contains the alkyl group having the same carbon number is 95% by weight or greater with respect to the total weight of the acylglycerol.

BRIEF DESCRIPTION OF THE DRAWINGS

Exemplary embodiments of the present invention will be described in detail based on the following figures, wherein.

DETAILED DESCRIPTION

Figure 1:
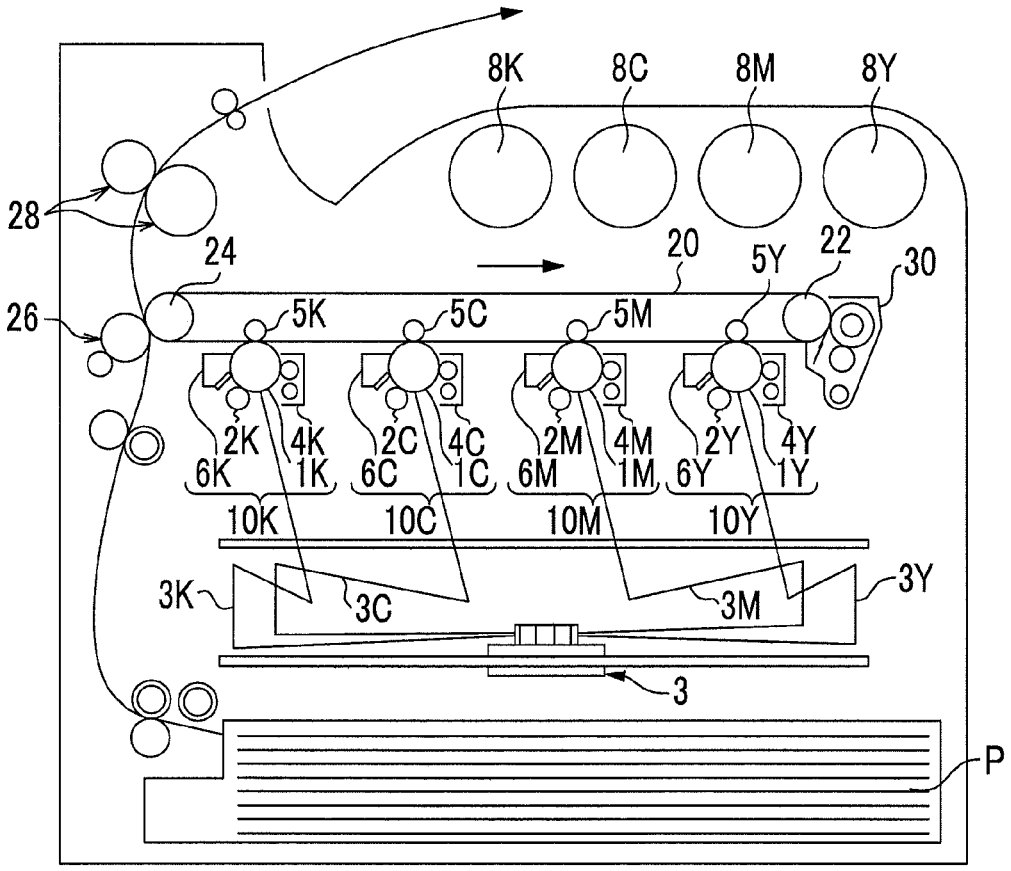
FIG. 1 is a diagram schematically illustrating an example of a configuration of an image forming apparatus according to an exemplary embodiment of the invention.

Hereinafter, exemplary embodiments of the invention will be described in detail.

Electrostatic Charge Image Developing Toner

An electrostatic charge image developing toner (hereinafter, referred to as "toner") according to an exemplary embodiment of the invention includes toner particles and an external additive. The toner particles contain: a styrene acrylic resin; and an acylglycerol, in which at least one of three hydroxyl groups in one molecule of glycerol is esterified with an alkyl monocarboxylic acid that contains a substituted or unsubstituted alkyl group having from 12 to 22 carbon atoms, and a content of a portion esterified with the alkyl monocarboxylic acid that contains the alkyl group having the same carbon number is 95% by weight or greater with respect to the total weight of the acylglycerol (hereinafter also referred to as "(S) acylglycerol").

In the toner according to the exemplary embodiment having the above-described configuration, deterioration in the anti-crease performance of an image is suppressed for a long period of time. The reason is not clear but is presumed to be as follows.

First, the styrene acrylic resin which is the binder resin of the toner particles includes a rigid styrene structure and a flexible acrylic structure (fox example, an alkyl(meth)acrylate) as a main structure. Since the styrene acrylic resin having the rigid styrene structure has hard and brittle properties, the anti-crease performance of an image including the styrene acrylic resin is decreased. The reason is presumed to be as follows. In the image including the styrene acrylic resin having the hard and rigid styrene structure in a side chain of a polymer, since the molecular mobility of the side chain is low, a toner melting property during fixing deteriorates, and the toner is difficult to penetrate in a sheet depth direction, which may cause cracking when the image is bent.

In the related art, in order to improve the anti-crease performance of an image including the styrene acrylic resin, a configuration in which a flexible polyester resin is used in combination with the styrene acrylic resin has been adopted (for example, JP-A-2005-316141). However, the compatibility between the polyester resin and the styrene acrylic resin as a resin property is low. Therefore, although the anti-crease performance of an image is temporarily improved by using the polyester resin in combination, the separation between the polyester resin and the styrene acrylic resin advances over time, and the anti-crease performance of the image deteriorates.

On the other hand, the (S) acylglycerol is a compound that contains a flexible long-chain alkyl group having from 12 to 22 carbon atoms in an ester structure, in which a ratio of a portion esterified with the alkyl monocarboxylic acid that contains the alkyl group having the same carbon number is high. Therefore, the molecular mobility tends to be high. As a result, it is presumed that the (S) acylglycerol penetrates into the styrene acrylic resin structure having the rigid styrene structure to develop the flexibility of a polymer structure. Therefore, it is presumed that the toner melting property is improved, the toner penetrates in the sheet depth direction, and thus image cracking is suppressed.

Further, it is presumed that, since the (S) acylglycerol includes the long-chain alkyl groups, the compatibility with the acrylic structure (for example, an alkyl(meth)acrylate) of the styrene acryl resin is high, and the separation over time is suppressed.

For the above-described reasons, it is presumed that deterioration in the anti-crease performance of an image is suppressed for a long period of time in the toner according to the exemplary embodiment.

In particular, when a ratio of the rigid styrene component in the styrene acrylic resin is increased (for example, when the ratio is 60% by weight or higher), the anti-crease performance of an image is likely to deteriorate. However, in the toner according to the exemplary embodiment, even when the styrene acrylic resin having a high ratio of the rigid styrene component is used, deterioration in the anti-crease performance of an image is likely to be suppressed.

In addition, when the volume of a fixing member is low and a processing speed is slow, the temperature of the fixing member is greatly decreased by fixing. Therefore, a toner image is not sufficiently heated, and the anti-crease performance of an image is likely to deteriorate. However, in the toner according to the exemplary embodiment, even when a toner image is not sufficiently heated, deterioration in the anti-crease performance of an image is likely to be suppressed.

In the toner according to the exemplary embodiment, even when the styrene acrylic resin and the (S) acylglycerol are used in combination, the glass transition temperature of the styrene acrylic resin is not greatly decreased. Therefore, the toner according to the exemplary embodiment has an advantageous effect in that there is little effect on a fixing property (for example, a phenomenon (hot offset) in which a toner is excessively heated and attached on a fixing member hardly occurs).

Hereinafter, the toner according to the exemplary embodiment will be described in detail.

The toner according to the exemplary embodiment includes toner particles and optionally further includes an external additive.

Toner Particles

The toner particles include, for example, a binder resin and optionally further includes a colorant, a release agent, and other additives.

Binder Resin

As the binder resin, an styrene acrylic resin is used.

As the styrene acrylic resin, for example, a copolymer obtained by copolymerization of at least a styrene and a (meth)acrylic acid ester is used. As the styrene acrylic resin, a copolymer obtained by polymerization of a styrene, a (meth)acrylic acid ester, and other monomers may be used.

The expression "(meth)acryl" described herein includes both "acryl" and "methacryl".

The styrene is a monomer having a styrene structure, and specific examples thereof include styrene; vinylnaphthalene; alkyl-substituted styrenes such as α-methylstyrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, or p-n-dodecylstyrene; aryl-substituted styrenes such as p-phenylstyrene; alkoxy-substituted styrenes such as p-methoxystyrene; halogen-substituted styrenes such as p-chlorostyrene or 3,4-dichlorostyrene; nitro-substituted sytrenes such as m-nitrostyrene, o-nitrostyrene, or p-nitrostyrene; and fluoro-substituted styrenes such as 4-fluorostyrene or 2,5-difluorostyrene. Among these, as the styrene, styrene, p-ethylstyrene, or p-n-butylstyrene is preferable.

These styrenes may be used alone or in a combination of two or more kinds.

The (meth)acrylic acid ester is a monomer having a structure in which (meth)acrylic acid is esterified, and specific examples thereof include alkyl(meth)acrylates such as n-methyl(meth)acrylate, n-ethyl(meth)acrylate, n-propyl(meth) acrylate, n-butyl(meth)acrylate, n-pentyl(meth)acrylate, n-hexyl(meth)acrylate, n-heptyl(meth)acrylate, n-octyl (meth)acrylate, n-decyl(meth)acrylate, n-dodecyl(meth) acrylate, n-lauryl(meth)acrylate, n-tetradecyl(meth)acrylate, n-hexadecyl(meth)acrylate, n-octadecyl(meth)acrylate, isopropyl(meth)acrylate, isobutyl(meth)acrylate, t-butyl(meth) acrylate, isopentyl(meth)acrylate, amyl(meth)acrylate, neopentyl(meth)acrylate, isohexyl(meth)acrylate, isoheptyl (meth)acrylate, isooctyl(meth)acrylate, 2-ethylhexyl(meth) acrylate, octyl(meth)acrylate, decyl(meth)acrylate, lauryl (meth)acrylate, or stearyl(meth)acrylate; carboxyl-substituted alkyl(meth)acrylates such as β-carboxyethyl (meth)acrylate; hydroxy-substituted alkyl(meth)acrylates such as 2-hydroxyethyl(meth)acrylate, 2-hydroxypropyl (meth)acrylate, 3-hydroxypropyl(meth)acrylate, 2-hydroxybutyl(meth)acrylate, 3-hydroxybutyl(meth)acrylate, or 4-hydroxybutyl(meth)acrylate; and alkoxy-substituted alkyl (meth)acrylates such as 2-methoxyethyl(meth)acrylate.

Among these (meth)acrylic acid esters, a (meth)acrylic acid ester having an alkyl group having from 2 to 14 carbon atoms (preferably from 2 to 10 carbon atoms and more preferably from 3 to 8 carbon atoms) is preferable from the viewpoint of fixing property.

These (meth)acrylic acid esters may be used alone or in a combination of two or more kinds.

Examples of other monomers include (meth)acrylic acids, ethylenically unsaturated nitriles (such as acrylonitrile or methacrylonitrile), vinyl ethers (such as vinyl methyl ether or vinyl isobutyl ether), vinyl ketones (such as vinyl methyl ketone, vinyl ethyl ketone, or vinyl isopropenyl ketone), divinyls (such as divinyl adipate), olefins (such as ethylene, propylene, or butadiene), thiols (such as dodecane thiol), and dicarboxylic acids (such as decanediol acrylate).

From the viewpoint of image storability, a ratio of a styrene to all the polymerizable components in the styrene acrylic resin is preferably 60% by weight or higher, more preferably from 65% by weight to 90% by weight, and still more preferably from 70% by weight to 85% by weight.

From the viewpoint of fixing property, a ratio of a (meth) acrylic acid ester to all the polymerizable components in the styrene acrylic resin is preferably from 10% by weight to 40% by weight and more preferably from 10% by weight to 35% by weight.

A glass transition temperature (Tg) of the styrene acrylic resin is preferably from 45° C. to 80° C. and more preferably from 45° C. to 65° C.

The glass transition temperature can be obtained from a DSC curve obtained by differential scanning calorimetry (DSC), more specifically, can be obtained by "extrapolation glass transition start temperature" described in a method of obtaining a glass transition temperature according to JIS K-1987 "method of measuring transition temperature of plastics".

A weight average molecular weight (Mw) of the styrene acrylic resin is preferably from 5000 to 700000 and more preferably 7000 to 300000.

A number average molecular weight (Mn) of the polyester resin is preferably from 2000 to 100000.

A molecular weight distribution Mw/Mn of the styrene acrylic resin is preferably from 1.0 to 100 and more preferably from 1.2 to 50.

The weight average molecular weight and the number average molecular weight are measured by gel permeation chromatography (GPC). The molecular weight measurement by GPC is performed in a THF solution by using HLC-8120GPC (GPC manufactured by Tosoh Corporation) as a measuring device and using TSKgel SuperHM-M (15 cm) (a column manufactured by Tosoh Corporation). The weight average molecular weight and the number average molecular weight are calculated using a molecular weight calibration curve that is prepared from a monodisperse polystyrene standard sample based on the measurement result.

The binder resin may further include other resins in addition to the styrene acrylic resin. In this case, the content of the styrene acrylic resin is preferably 60% by weight or greater (preferably 80% by weight or greater) with respect to the total weight of the binder resin.

Examples of other resins include vinyl resins other than the styrene acrylic resin and non-vinyl-based resins such as epoxy resins, polyester resins, polyurethane resins, polyamide resins, cellulose resins, polyether resins, or modified rosins.

The content of the binder resin is, for example, preferably from 40% by weight to 95% by weight, more preferably from 50% by weight to 90% by weight, and still more preferably from 60% by weight to 90% by weight with respect to the total weight of the toner particles.

(S) Acylglycerol

The (S) acylglycerol is an acylglycerol in which at least one hydroxyl group of three hydroxyl groups in one molecule of glycerol (glycerin: $C_3H_8O_3$) is esterified with an alkyl monocarboxylic acid that contains a substituted or unsubstituted alkyl group having from 12 to 22 carbon atoms. In the (S) acylglycerol, a content of a portion esterified with the alkyl monocarboxylic acid that contains the alkyl group having the same carbon number is 95% by weight or greater. In this case, when at least two hydroxyl groups in one molecule of glycerol are the portion esterified with the alkyl monocarboxylic acids, the alkyl groups of the alkyl monocarboxylic acids esterifying at least two hydroxyl groups have the same carbon number.

The (S) acylglycerol does not substantially have a release function and is a material different from a release agent.

In the (S) acylglycerol, the carbon number of the alkyl group (the carbon number of the unsubstituted alkyl group) of the esterified alkyl monocarboxylic acid is from 12 to 22 and more preferably from 13 to 20. When this carbon number is less than 12, the (S) acylglycerol is liquid and cannot be blended into the toner particles. On the other hand, when the carbon number is more than 22, the molecular mobility is excessively developed, the separation with a phenyl group becomes significant, and thus it is difficult to maintain the anti-crease performance of an image for a long period of time. Examples of a resin having a phenyl group include styrene alone or a resin containing styrene as a copolymerizable component.

The content of the acylglycerol esterified with the alkyl monocarboxylic acid that contains the alkyl group having the same carbon number is 95% by weight or more and preferably 97% by weight or more with respect to the total weight of the (S) acylglycerol.

In the (S) acylglycerol, it is preferable that at least two of three hydroxyl groups (preferably all of three hydroxyl groups) in one molecule of glycerol (glycerin: $C_3H_8O_3$) be the portion esterified with the alkyl monocarboxylic acid. In acylglycerol having no hydroxyl groups or a small number of hydroxyl groups, the compatibility with a polymer main chain structure of the resin having a phenyl group is likely to increase, the separation over time is suppressed, and thus deterioration in the anti-crease performance of an image is likely to be suppressed for a long period of time.

Specifically, the (S) acylglycerol is represented by the following formula (AG).

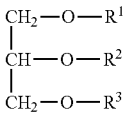

(AG)

In the formula (AG), $R^1$, $R^2$, and $R^3$ each independently represent a hydrogen atom or —C(=O)—R, R represents a substituted or unsubstituted alkyl group having from 12 to 22 carbon atoms, and at least one of $R^1$, $R^2$, and $R^3$ represents —C(=O)—R.

In the formula (AG), the unsubstituted alkyl group represented by R is an alkyl group having preferably from 12 to 22 carbon atoms and more preferably from 13 to 20 carbon atoms. The unsubstituted alkyl group may be linear, branched, or cyclic, but is preferably linear or branched and more preferably linear from the viewpoints of easily suppressing deterioration in the anti-crease performance of an image.

Examples of the linear alkyl group include n-dodecyl, n-tridecyl, n-tetradecyl, n-pentadecyl, n-hexadecyl, n-heptadecyl, n-stearyl, n-nonadecyl, n-eicosyl, n-heneicosyl, and n-docosyl.

Examples of the branched alkyl group include isododecyl, s-dodecyl, t-dodecyl, tridecyl, s-tridecyl, t-tridecyl, isotetradecyl, s-isotetradecyl, t-isotetradecyl, isopentadecyl, s-pentadecyl, t-pentadecyl, hexyldecyl, isohexadecyl, s-hexadecyl, t-hexadecyl, isoheptadecyl, s-heptadecyl, t-heptadecyl, isostearyl, s-stearyl, t-stearyl, isononadecyl, s-nonadecyl, t-nonadecyl, isoicosyl, s-icosyl, t-icosyl, isoeicosyl, s-eicosyl, t-eicosyl, isohenicosyl, s-henicosyl, t-henicosyl, isodocosyl, s-docosyl, and t-docosyl.

In the formula (AG), it is preferable that at least two (particularly all of three) of $R^2$, and $R^3$ represent —C(=O)—R from the viewpoints of easily suppressing deterioration in the anti-crease performance of an image.

Specific examples of the (S) acylglycerol include tripalmitin glycerol, dipalmitin glycerol, monopalmitin glycerol, trilaurin glycerol, dilaurin glycerol, monolaurin glycerol, trimyristin glycerol, dimyristin glycerol, monomyristin glycerol, tristearin glycerol, distearin glycerol, monostearin glycerol, tribehenin glycerol, dibehenin glycerol, and monobehenin glycerol. However, the (S) acylglycerol are not limited to these specific examples.

The content of the (S) acylglycerol is, for example, preferably from 2% by weight to 30% by weight and more preferably from 5% by weight to 20% by weight with respect to the total weight of the toner particles.

Colorant

Examples of colorants include various pigments such as Carbon Black, Chrome Yellow, Hansa Yellow, Benzidine Yellow, Thren Yellow, Quinoline Yellow, Pigment Yellow, Permanent Orange GTR, Pyrazolone Orange, Balkan Orange, Watchyoung Red, Permanent Red, Brilliant Carmine 3B, Brilliant Carmine 6B, Dupont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, or Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, or thiazole dyes.

These colorants may be used alone or in a combination of two or more kinds.

The colorant may be optionally surface-treated or may be used in combination with a dispersant. In addition, plural kinds of colorants may be used in combination.

The content of the colorant is, for example, preferably from 1% by weight to 30% by weight and more preferably from 3% by weight to 15% by weight with respect to the total weight of the toner particles.

Release Agent

Examples of the release agent include hydrocarbon waxes; natural waxes such as carnauba wax, rice wax, candelilla wax; synthetic or mineral and petroleum waxes such as montan wax; and ester waxes such as fatty acid esters or montanic acid esters. The release agent is not limited to these examples.

A melting temperature of the release agent is preferably from 50° C. to 110° C. and more preferably from 60° C. to 100° C.

The melting temperature can be obtained from a DSC curve obtained by differential scanning calorimetry (DSC) using "melting peak temperature" described in a method of obtaining a melting temperature according to JIS K-1987 "method of measuring transition temperature of plastics".

The content of the release agent is, for example, preferably from 1% by weight to 20% by weight and more preferably from 3% by weight to 15% by weight with respect to the total weight of the toner particles.

Other Additives

Examples of other additives include well-known additives such as a magnetic material, a charge-controlling agent, or an inorganic powder. The toner particles contain these additives as internal additives.

Properties and the Like of Toner Particles

The toner particles may have a single-layer structure or a so-called core-shell structure including a core (core particles) and a coating layer (shell layer) for coating the core.

For example, the toner particles having a core-shell structure include: a core that includes the styrene acrylic resin and the (S) acylglycerol and optionally further includes other additives such as the colorant and the release agent; and a coating layer that includes the styrene acrylic resin.

A volume average particle size (D50v) of the toner particles is preferably from 2 μm to 15 μm and more preferably from 3 μm to 9 μm.

Various average particle sizes and various particle size distribution indices of the toner particles are measured using COULTER MULTISIZER II (manufactured by Beckman Coulter Inc.) and ISOTON-II (manufactured by Beckman Coulter Inc.) as an electrolytic solution.

During the measurement, from 0.5 mg to 50 mg of a measurement sample is added to 2 ml of 5% aqueous solution of a surfactant (preferably, sodium alkylbenzene sulfonate) as a dispersant. This solution is added to from 100 ml to 150 ml of the electrolytic solution.

The electrolytic solution in which the sample is suspended is dispersed with an ultrasonic dispersing machine for 1 minute, and a particle size distribution of particles having a particle size of from 2 μm to 60 μm is measured with COULTER MULTISIZER II using an aperture having an aperture size of 100 μm. The number of particles to be sampled is 50000.

Based on the measured particle size distribution, a volume cumulative distribution and a number cumulative distribution are drawn from the smallest particle size side in divided particle size ranges (channels). Particle sizes having a cumulative value of 16% are defined as a volume average particle size D16v and a number average particle size D16p, respectively. Particle sizes having a cumulative value of 50% are defined as a volume average particle size D50v and a number average particle size D50p, respectively. Particle sizes having a cumulative value of 84% are defined as a volume average particle size D84v and a number average particle size D84p, respectively.

Using these values, a volume average particle size distribution index (GSDv) is calculated from $(D84v/D16v)^{1/2}$, and a number average particle size distribution index (GSDp) is calculated from $(D84p/D16p)^{1/2}$.

A shape factor SF1 of the toner particles is preferably from 110 to 150 and more preferably from 120 to 140.

The shape factor SF1 is calculated from the following expression.

$$SF1=(ML^2/A)\times(\pi/4)\times 100 \quad \text{Expression}$$

In the expression, ML represents the absolute maximum length of a toner particle, and A represents the projection area of the toner particle.

Specifically, the shape factor SF1 is calculated as follows after primarily a microscopic image or a scanning electron microscopic (SEM) image is analyzed using an image analyzer to be quantified. That is, an optical microscopic image of particles dispersed on a slide glass surface is input into a LUZEX analyzer through a video camera, and maximum lengths and projection areas of 100 particles are obtained, shape factors of the particles are calculated from the above-described expression, and the average value thereof is obtained as the shape factor SF1.

(External Additive)

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$ $Al_2O_3.2SiO_2$, $CaCO_3$, $MgCO_3$, $BaSO_4$, and $MgSO_4$.

Surfaces of the inorganic particles as the external additive may preferably be treated with a hydrophobizing agent. The hydrophobizing treatment may be performed by, for example, dipping the inorganic particles in a hydrophobizing agent. The hydrophobizing agent is not particularly limited, and examples thereof include a silane coupling agent, silicone oil, a titanate coupling agent, and an aluminum coupling agent. These hydrophobizing agents may be used alone or in a combination of two or more kinds.

Typically, the amount of the hydrophobizing agent is, for example, from 1 part by weight to 10 parts by weight with respect to 100 parts by weight of the inorganic particles.

Examples of the external additive include resin particles (resin particles of polystyrene, PMMA, or melamine resin), a cleaning activator (for example, particles of a metal salt of a higher fatty acid represented by zinc stearate or a fluoropolymer).

The amount of the external additive which is externally added is, for example, preferably from 0.01% by weight to 5% by weight and more preferably from 0.01% by weight to 2.0% by weight with respect to the total weight of the toner particles.

A coverage of the external additive to the toner particles (hereinafter, referred to as "the coverage of the external additive") is, for example, preferably from 60% to 120% and more preferably from 60% to 100%. When the coverage of the external additive is in the above-described range, powder properties (for example, fluidity) of the toner are likely to increase. In particular, in the toner particles including the (S) acylglycerol, the powder properties of the toner may deteriorate due to the flexible alkyl group included in the (S) acylglycerol. In this case, when the coverage of the external additive is in the above-described range, deterioration in the powder properties of the toner is suppressed, and the powder properties are improved.

The coverage of silica particles is a value which is measured as follows.

10 toner surface images which are magnified to 100000 times are obtained per sample using an ultra high resolution field emission scanning electron microscope (FE-SEM, SU8040 (manufactured by Hitachi High-Technologies Corporation)) and are binarized by image analysis software (Win roof (manufactured by Mitani Corporation)) to classify toner particle surfaces and silica particles, and area ratios thereof are obtained to calculate the coverage ratio of the silica particles therefrom.

Method of Preparing Toner

Next, a method of preparing the toner according to the exemplary embodiment will be described.

The toner according to the exemplary embodiment is obtained by preparing the toner particles and adding the external additive to the toner particles.

The toner particles may be prepared using either a dry method (for example, kneading and pulverizing method) or wet method (for example, an aggregation and coalescence method, a suspension polymerization method, or a dissolution suspension method). The method of preparing the toner particles is not limited to these methods, and a well-known method may be adopted.

Among these, the aggregation and coalescence method is preferable to prepare the toner particles.

Specifically, for example, when the toner particles are prepared using the aggregation and coalescence method, the toner particles are prepared through the following processes including: a process (dispersion preparing process) of preparing a resin particle dispersion in which resin particles of the binder resin are dispersed and a glycerol particle dispersion in which particles of the (S) acylglycerol are dispersed; a process (aggregated particle forming process) of mixing the resin particle dispersion with the glycerol particle dispersion to make the resin particles and the particles of the (S) acylglycerol (and optionally, other particles) aggregate in the mixed dispersion (optionally, in the mixed dispersion after other particle dispersions are further mixed therewith) such that aggregated particles are formed; and a process (coalescence process) of heating the aggregated particle dispersion in which the aggregated particles are dispersed to make the aggregated particles coalesce such that toner particles are formed.

Hereinafter, each process will be described in detail.

In the following description, a method of preparing the toner particles including the colorant and the release agent will be described, but the colorant and the release agent are optionally used. Of course, other additives than the colorant and the release agent may be used.

Resin Particle Dispersion Preparing Process

First, in addition to the resin particle dispersion in which the resin particles of the binder resin are dispersed and the glycerol particle dispersion in which the particles of the (S) acylglycerol are dispersed, for example, a colorant particle dispersion in which colorant particles are dispersed and a release agent particle dispersion in which release agent particles are dispersed are prepared.

For example, the resin particle dispersion is prepared by dispersing the resin particles in a dispersion medium using a surfactant.

Examples of the dispersion medium used in the resin particle dispersion include an aqueous medium.

Examples of the aqueous medium include water such as distilled water or ion exchange water and alcohols. These media may be used alone or in a combination of two or more kinds.

Examples of the surfactant include anionic surfactants such as sulfates, sulfonates, phosphates, or soaps; cationic surfactants such as amine salts or quaternary ammonium salts; and nonionic surfactants such as polyethylene glycols, alkyl phenol ethylene oxide adducts, or polyols. Among these, anionic surfactants and cationic surfactants are preferable. Nonionic surfactants may be used in combination with anionic surfactants or cationic surfactants.

These surfactants may be used alone or in a combination of two or more kinds.

Regarding the resin particle dispersion, examples of a method of dispersing the resin particles in the dispersion medium include commonly-used dispersing methods using a rotary shearing type homogenizer or a medium-type dispersing machine such as a ball mill, a sand mill, or a dyno mill. In addition, depending on the kind of the resin particles, the resin particles may be dispersed in the resin particle dispersion using, for example, a phase-transfer emulsification method.

In the phase-transfer emulsification method, a dispersion target resin is dissolved in a hydrophobic organic solvent in which the resin is soluble, a base is added to an organic continuous phase (O phase) to neutralize the solution, and an aqueous medium (W phase) is put into the solution. As a result, the phase of the resin is transferred (so-called phase transfer) from W/O to O/W to become a discontinuous phase, and the resin in the particle form is dispersed in the aqueous medium.

A volume average particle size of the resin particles dispersed in the resin particle dispersion is, for example, preferably from 0.01 μm to 1 μm, more preferably from 0.08 μm to 0.8 μm, and still more preferably from 0.1 μm to 0.6 μm.

The volume average particle size of the resin particles is obtained as follows. Using a particle size distribution which is obtained by the measurement of a laser diffraction particle size distribution analyzer (for example, LA-700, manufactured by Horiba Ltd.), a volume cumulative distribution is drawn from the smallest particle size side in divided particle size ranges (channels), and a particle size having a cumulative value of 50% with respect to all the particles is defined as the volume average particle size D50v. Volume average particle sizes of particles in other dispersions are also be measured using the same method as above.

The content of the resin particles in the resin particle dispersion is, for example, preferably from 5% by weight to 50% by weight and more preferably from 10% by weight to 40% by weight.

For example, the colorant particle dispersion and the release agent particle dispersion are also prepared using the same preparation method as that of the resin particle dispersion. That is, regarding the volume average particle size, the dispersion medium, the dispersing method, and the content of the particles in the resin particle dispersion, the same shall be applied to the colorant particles to be dispersed in the colorant particle dispersion and the release agent particles to be dispersed in the release agent particle dispersion.

For example, the glycerol particle dispersion is prepared as follows. First, the (S) acylglycerol is dissolved in a good solvent (for example, ethyl acetate, hexane, acetone, or methylene chloride) to prepare a solution. An aqueous medium is added to this solution, followed by stirring and suspending with a dispersing machine such as a rotary shearing type homogenizer. As a result, a suspension is prepared. When this suspension is prepared, a well-known dispersant (emulsifier) such as a surfactant may be added thereto. The good solvent is removed from the obtained suspension by heating such that the (S) acylglycerol in the particle form is precipitated. As a result, the glycerol particle dispersion in which the particles of the (S) acylglycerol are dispersed is obtained.

Aggregated Particle Forming Process

Next, the resin particle dispersion, the glycerol particle dispersion, the colorant particle dispersion, and the release agent particle dispersion are mixed with each other.

The resin particles, the particles of the (S) acylglycerol, the colorant particles, and the release agent particles are made to hetero-aggregate in the mixed dispersion. As a result, aggregated particles that have a particles size close to a desired particle size of the toner particles and contain the resin particles, the particles of the (S) acylglycerol, the colorant particles, and the release agent particles are formed.

Specifically, for example, the aggregated particles are formed using a method including: adding a coagulant to the mixed dispersion; adjusting the pH of the mixed dispersion to be acidic (for example, from 2 to 5); optionally adding a dispersion stabilizer; and heating the mixed dispersion to glass transition temperature of the resin particles (specifically, for example, from (the glass transition temperature of the resin particles−30° C.) to (the glass transition temperature of the resin particles−10° C.)) so as to make the particles dispersed in the mixed dispersion aggregate.

In the aggregated particle forming process, for example, the mixed dispersion may be heated in the above-described manner after adding the coagulant thereto at room temperature (for example, 25° C.) while stirring the mixed dispersion with a rotary shearing type homogenizer, adjusting the pH of the mixed dispersion to be acidic (for example, from 2 to 5), and optionally adding the dispersion stabilizer thereto.

As the coagulant, for example, a surfactant having a polarity opposite to that of the surfactant which is added to the mixed dispersion to be used as the dispersant may be used, and examples thereof include an inorganic metal salt and a divalent or higher polyvalent metal complex. In particular, when a metal complex is used as the coagulant, the amount of the surfactant used is decreased, and charging characteristics are improved.

Optionally, an additive which forms a complex or an equivalent bond with metal ions of the coagulant may be used. As this additive, a chelating agent is preferably used.

Examples of the inorganic metal salt include a metal salt such as calcium chloride, calcium nitrate, barium chloride, magnesium chloride, zinc chloride, aluminum chloride, or aluminum sulfate; and an inorganic metal salt polymer such as polyaluminum chloride, polyaluminum hydroxide, or calcium polysulfide.

As the chelating agent, a water-soluble chelating agent may be used. Examples of the chelating agent include oxycarboxylic acid such as tartaric acid, citric acid or gluconic acid, iminodiacetic acid (IDA), nitrilotriacetic acid (NTA), and ethylenediamine tetraacetic acid (EDTA).

The amount of the chelating agent added is, for example, preferably from 0.01 part by weight to 5.0 parts by weight and more preferably from 0.1 part by weight to less than 3.0 parts by weight with respect to 100 parts by weight of the resin particles.

Coalescence Process

Next, the aggregated particle dispersion in which the aggregated particles are dispersed is heated to be higher than or equal to the glass transition temperature of the resin particles (for example, to be higher than the glass transition temperature of the resin particles by 10° C. to 30° C. or higher) to make the aggregated particles coalesce such that toner particles are formed.

Through the above-described processes, the toner particles are obtained.

The toner particles may be prepared through the following processes including: a process of obtaining the aggregated particle dispersion in which the aggregated particles are dispersed, mixing the aggregated particle dispersion with the resin particle dispersion in which the resin particles are dispersed, making the resin particles aggregate to be attached on surfaces of the aggregated particles such that second aggregated particles are formed; a process of heating a second aggregated particle dispersion in which the second aggregated particles are dispersed to make the second aggregated particles coalesce such that toner particles having a core-shell structure are formed.

After completion of the coalescence process, the toner particles formed in the solution are treated in well-known processes including a washing process, a solid-liquid separation process, and a drying process to obtain dry toner particles.

In the washing process, it is preferable that sufficient displacement washing with ion exchange water be performed from the viewpoint of a charging property. In addition, the solid-liquid separation process is not particularly limited, but it is preferable that suction filtration, pressure filtration, or the like be performed from the viewpoint of productivity. In addition, the drying process is not particularly limited, but it is preferable, freeze-drying, flash jet drying, fluidized drying, vibration fluidized drying, or the like be performed from the viewpoint of productivity.

For example, the toner according to the exemplary embodiment is prepared by adding the external additive to the obtained dry toner particles to be mixed with each other. It is preferable that mixing be performed using, for example, a V-blender, a Henschel mixer, a Loedige mixer. Further, optionally, coarse particles of the toner may be removed using a vibration screener or an air classifier.

Electrostatic Charge Image Developer

The electrostatic charge image developer according to the exemplary embodiment contains at least the toner according to the exemplary embodiment.

The electrostatic charge image developer according to the exemplary embodiment may be a single-component developer containing only the toner according to the exemplary embodiment or a two-component developer in which the toner and a carrier are mixed.

The carrier is not particularly limited, and a well-known carrier may be used. Examples of the carrier include a coated carrier in which a core surface formed of magnetic powder is coated with a coating resin; a magnetic powder-dispersed carrier in which magnetic powder is dispersed and blended in a matrix resin; a resin-impregnated carrier in which porous magnetic powder is impregnated with resin; and a resin-dispersed carrier in which conductive particles are dispersed and blended in a matrix resin.

The magnetic powder-dispersed carrier, resin-impregnated carrier, and the conductive particle-dispersed carrier may be carriers in which constituent particles of the carrier are used as a core; and the core is coated with a coating resin.

Examples of the magnetic powder include magnetic metals such as iron, nickel, or cobalt; and magnetic oxides such as ferrite or magnetite. It is preferable that the developer contain from 10 ppm to 150 ppm of nickel such that the lacking of the carrier or the peeling of the coating resin is suppressed. As a result, there are few cases where the carrier materials be mixed with the toner, and thus deterioration in the anti-crease performance of an image can be suppressed.

Examples of the conductive particles include particles of metals such as gold, silver, or copper and particles of carbon black, titanium oxide, zinc oxide, tin oxide, barium sulfate, aluminum borate, potassium titanate, or the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin containing an organosiloxane bond or modified products thereof, a fluororesin, polyester, polycarbonate, a phenol resin, and an epoxy resin.

The coating resin and the matrix resin may contain other additives such as a conductive material.

Examples of a method of coating the core surface with the coating resin include a coating method using a coating layer-forming solution in which the coating resin and optionally various additives are dissolved in an appropriate solvent. The solvent is not particularly limited and may be selected in consideration of the coating resin to be used, the coating aptitude, and the like.

Specific examples of the resin coating method include a dipping method of dipping the core in the coating layer-forming solution; a spray method of spraying the coating layer-forming solution on the core surface; a fluid bed method of spraying the coating layer-forming solution on the core surface while making the core float with flowing air; and a kneader coater method of mixing the core of the carrier with the coating layer-forming solution in a kneader coater and removing a solvent.

In the two-component developer, a mixing ratio (weight ratio) of the toner to the carrier (toner:carrier) is preferably 1:100 to 30:100 and more preferably from 3:100 to 20:100.

Image Forming Apparatus and Image Forming Method

An image forming apparatus and an image forming method according to the exemplary embodiment will be described.

The image forming method according to the exemplary embodiment includes: an image holding member; a charging unit that charges a surface of the image holding member; an electrostatic charge image forming unit that forms an electrostatic charge image on a charged surface of the image holding member; a developing unit that accommodates an electrostatic charge image developer and forms a toner image by developing the electrostatic charge image, which is formed on the surface of the image holding member, using the electrostatic charge image developer; a transfer unit that transfers the toner image, which is formed on the surface of the image holding member, onto a surface of a recording medium; and a fixing unit that fixes the toner image which is transferred onto the surface of the recording medium. In this case, as the electrostatic charge image developer, the electrostatic charge image developer according to the exemplary embodiment is used.

The image forming apparatus according to the exemplary embodiment performs an image forming method (the image forming method according to the exemplary embodiment), the image forming method including: a charging process of charging a surface of an image holding member; an electrostatic charge image forming process of forming an electrostatic charge image on a charged surface of the image holding member; a developing process of forming a toner image by developing the electrostatic charge image, which is formed on the surface of the image holding member, using the electrostatic charge image developer according to the exemplary embodiment; a transfer process of transferring the toner image, which is formed on the surface of the image holding member, onto a surface of a recording medium; and a fixing process of fixing the toner image which is transferred onto the surface of the recording medium.

As the image forming apparatus according to the exemplary embodiment, well-known image forming apparatuses are applied including: a direct transfer type apparatus in which the toner image formed on the surface of the image holding member is directly transferred onto the recording medium; an intermediate transfer type apparatus in which the toner image formed on the surface of the image holding member is primarily transferred onto a surface of an intermediate transfer member, and the toner image transferred onto the surface of the intermediate transfer member is secondarily transferred onto the surface of the recording medium; an apparatus including a cleaning unit that cleans the surface of the image holding member after transferring the toner image and before charging the surface; and an apparatus including an erasing unit that irradiates the surface of image holding member with erasing light to erase charge after transferring the toner image and before charging the surface.

When the intermediate transfer type apparatus is used, for example, the transfer unit includes an intermediate transfer member onto a surface of which the toner image is transferred; a primary transfer unit that primarily transfers the toner image, which is formed on the surface of the image holding member, to a surface of the intermediate transfer member; and a secondary transfer unit that secondarily transfers the toner image, which is transferred onto the surface of the intermediate transfer member, onto the surface of the recording medium.

In the image forming apparatus according to the exemplary embodiment, for example, a portion including the developing unit may be a cartridge structure (process cartridge) which is detachable from the image forming apparatus. As the process cartridge, for example, a process cartridge that accommodates the electrostatic charge image developer according to the exemplary embodiment and includes the developing unit is preferably used.

Hereinafter, an example of the image forming apparatus according to the exemplary embodiment will be described, but the image forming apparatus is not limited thereto. Major components illustrated in the drawing will be described, and the other components will not be described.

FIG. 1 is a diagram schematically illustrating a configuration of the image forming apparatus according to the exemplary embodiment.

The image forming apparatus illustrated in FIG. 1 includes first to fourth electrophotographic image forming units 10Y, 10M, 10C, and 10K (image forming unit) that output images of the respective colors of yellow (Y), magenta (M), cyan (C), and black (K) based on color-separated image data. These image forming units (hereinafter, also simply referred to as "units") 10Y, 10M, 10C, and 10K are horizontally arranged in parallel at predetermined intervals. These units 10Y, 10M, 10C, and 10K may be process cartridges which are detachable from the image forming apparatus.

On an upper section of the respective units 10Y, 10M, 10C, and 10K in the drawing, an intermediate transfer belt 20 which is an intermediate transfer member extends through the respective units. The intermediate transfer belt 20 is wound around a driving roller 22 and a supporting roller 24 in contact with an inner surface of the intermediate transfer belt 20, in which the rollers are arranged to be distant from each other in a direction from the left to the right in the drawing. The intermediate transfer belt 20 travels in a direction from the first unit 10Y to the fourth unit 10K. A force is applied to the supporting roller 24 in a direction away from the driving roller 22 by a spring (not illustrated), and a tension is applied to the intermediate transfer belt 20 which is wound around both the driving roller 22 and the supporting roller 24. In addition, on an image holding member side surface of the intermediate transfer belt 20, an intermediate transfer member cleaning device 30 is provided opposite the driving roller 22.

In addition, toners of four colors of yellow, magenta, cyan, and black that are accommodated in toner cartridges 8Y, 8M, 8C, and 8K are supplied to the respective developing devices (developing units) 4Y, 4M, 4C, and 4K of the respective units 10Y, 10M, 10C, and 10K.

Since the first to fourth units 10Y, 10M, 10C, and 10K have the same configuration, the first unit 10Y that is arranged on an upstream side in a travelling direction of the intermediate transfer belt and forms a yellow image will be described as a representative example. The same components as those of the first unit 10Y are represented by reference numerals to which the symbols M (magenta), C (cyan), and K (black) are attached instead of Y (yellow), and the descriptions of the second to fourth units 10M, 10C, and 10K will not be repeated.

The first unit 10Y includes a photoreceptor 1Y that acts as the image holding member. Around the photoreceptor 1Y, a charging roller (an example of the charging unit) 2Y that charges a surface of the photoreceptor 1Y to a predetermined potential; an exposure device (an example of the electrostatic charge image forming unit) 3 that exposes the charged surface to laser beam 3Y based on divided color image signals to form an electrostatic charge image; a developing device (an example of the developing unit) 4Y that supplies the charged toner to the electrostatic charge image to develop the electrostatic charge image; a primary transfer roller (an example of the primary transfer unit) 5Y that transfers the developed toner image onto the intermediate transfer belt 20; and a photoreceptor cleaning device (an example of the cleaning unit) 6Y that removes toner remaining on the surface of the photoreceptor 1Y after the primary transfer are arranged in this order.

The primary transfer roller 5Y is arranged inside the intermediate transfer belt 20 and is provided at a position opposite the photoreceptor 1Y. Further, bias power supplies (not illustrated) that apply primary transfer biases are connected to the respective primary transfer rollers 5Y, 5M, 5C, and 5K, respectively. A controller (not illustrated) controls the respective bias power supplies to change the primary transfer biases that are applied to the respective primary transfer rollers.

Hereinafter, the operation of forming a yellow image in the first unit 10Y will be described.

First, before the operation, the surface of the photoreceptor 1Y is charged to a potential of from −600 V to −800 V by the charging roller 2Y.

The photoreceptor 1Y is formed by laminating a photosensitive layer on a conductive substrate (for example, volume resistivity at 20° C.: $1\times10^{-6}$ Ωcm or lower). Typically, this photosensitive layer has high resistance (resistance of a commonly-used resin) and, when being irradiated with the laser beam 3Y, has a property in which the specific resistance of portions irradiated with the laser beam 3Y is changed. Therefore, the laser beam 3Y is output to the charged surface of the photoreceptor 1Y through the exposure device 3 based on yellow image data sent from the controller (not illustrated). The irradiation with the laser beam 3Y is performed on the photosensitive layer of the surface of the photoreceptor 1Y. As a result, an electrostatic charge image having a yellow image pattern is formed on the surface of the photoreceptor 1Y.

The electrostatic charge image is an image which is formed by charging on the surface of the photoreceptor 1Y and is a so-called negative latent image which is formed in the following manner: the specific resistance of the portions of the photosensitive layer which are irradiated with the laser beam 3Y is decreased and charge flows through the surface of the photoreceptor 1Y; whereas, charge remains in portions of the photosensitive layer which are not irradiated with the laser beam 3Y.

The electrostatic charge image formed on the photoreceptor 1Y is rotated to a predetermined developing position along with the traveling of the photoreceptor 1Y. At this developing position, the electrostatic charge image on the photoreceptor 1Y is visualized (developed) as the toner image by the developing device 4Y.

In the developing device 4Y, an electrostatic charge image developer containing at least yellow toner and a carrier is accommodated. The yellow toner is frictionally charged by being agitated in the developing device 4Y and is held on an developer roller (an example of a developer holding member) while having the same polarity (negative polarity) as that of charge on the photoreceptor 1Y. By the surface of the photoreceptor 1Y passing through the developing device 4Y, the yellow toner is electrostatically attached on an erased latent image portion on the surface of the photoreceptor 1Y, and a latent image is developed by the yellow toner. The photoreceptor 1Y on which the yellow toner image is formed travels continuously at a predetermined speed such that the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force is applied to the toner image in a direction from the photoreceptor 1Y to the primary transfer roller 5Y, and the toner image on the photoreceptor 1Y is transferred onto the intermediate transfer belt 20. The transfer bias applied at this time has (+) polarity which is opposite to (−) polarity of the toner and is controlled to +10 μA by the controller (not illustrated) in, for example, the first unit 10Y.

On the other hand, toner remaining on the photoreceptor 1Y is removed and collected by the photoreceptor cleaning device 6Y.

Further, primary transfer biases that are applied to the primary transfer rollers 5M, 5C, and 5K of the second to fourth units 10M, 10C, and 10K are controlled in the same manner as that of first unit.

In this way, the intermediate transfer belt 20 onto which the yellow toner image is transferred by the first unit 10Y sequentially passes through the second to fourth units 10M, 10C, and 10K, and toner images of the respective colors are superimposed and multiply transferred.

The intermediate transfer belt 20 onto which the toner images of the four colors are multiply transferred through the first to fourth units reaches a secondary transfer portion including: the intermediate transfer belt 20; the supporting roller 24 that is in contact with the inner surface of the intermediate transfer belt; and a secondary transfer roller (an example of the secondary transfer unit) 26 that is arranged on the image holding member surface side of the intermediate transfer belt 20. Meanwhile, a recording paper (an example of the recording medium) P is supplied to a nip portion in contact with the secondary transfer roller 26 and the intermediate transfer belt 20 through a supply mechanism at a predetermined timing, and a secondary transfer bias is applied to the supporting roller 24. The secondary transfer bias applied at this time has (−) polarity which is the same as that of (−) polarity of the toner, an electrostatic force is applied to the toner image in a direction from the intermediate transfer belt 20 to the recording paper P, and the toner image on the intermediate transfer belt 20 is transferred onto the recording paper P. At this time, the secondary transfer bias is determined based on resistance which is detected by a resistance detecting unit (not illustrated) for detecting the resistance of the secondary transfer portion, and the voltage thereof is controlled.

Next, the recording paper P is transported to a nip portion between a pair of fixing rollers in a fixing device (an example of the fixing unit) 28, the toner image is fixed on the recording paper P, and a fixed image is formed.

Examples of the recording paper P onto which the toner image is transferred include plain paper which is used for electrophotographic copying machines, printers, and the like. As the recording medium, for example, OHP sheets may be used in addition to the recording paper P.

In order to further improve the smoothness of an image surface after fixing, it is preferable that the surface of the recording paper P be also smooth. For example, coated paper obtained by coating a surface of plain paper with resin or the like and art paper for printing are preferably used.

The recording paper P on which the color images are fixed is transported to a discharge portion, and a series of color image forming operations are finished.

Process Cartridge/Toner Cartridge

The process cartridge according to the exemplary embodiment will be described.

The process cartridge according to the exemplary embodiment includes the developing unit that accommodates the electrostatic charge image developer according to the exemplary embodiment and forms a toner image by developing the electrostatic charge image, which is formed on the surface of the image holding member, using the electrostatic charge image developer. This process cartridge is detachable from an image forming apparatus.

The process cartridge according to the exemplary embodiment is not limited to the above-described configuration and may include the developing device and optionally may further include at least one selected from the other units such as the image holding member, the charging unit, the electrostatic charge image forming unit, and the transfer unit.

Hereinafter, an example of the process cartridge according to the exemplary embodiment will be described, but the process cartridge is not limited thereto. Major components illustrated in the drawing will be described, and the other components will not be described.

Figure 2:
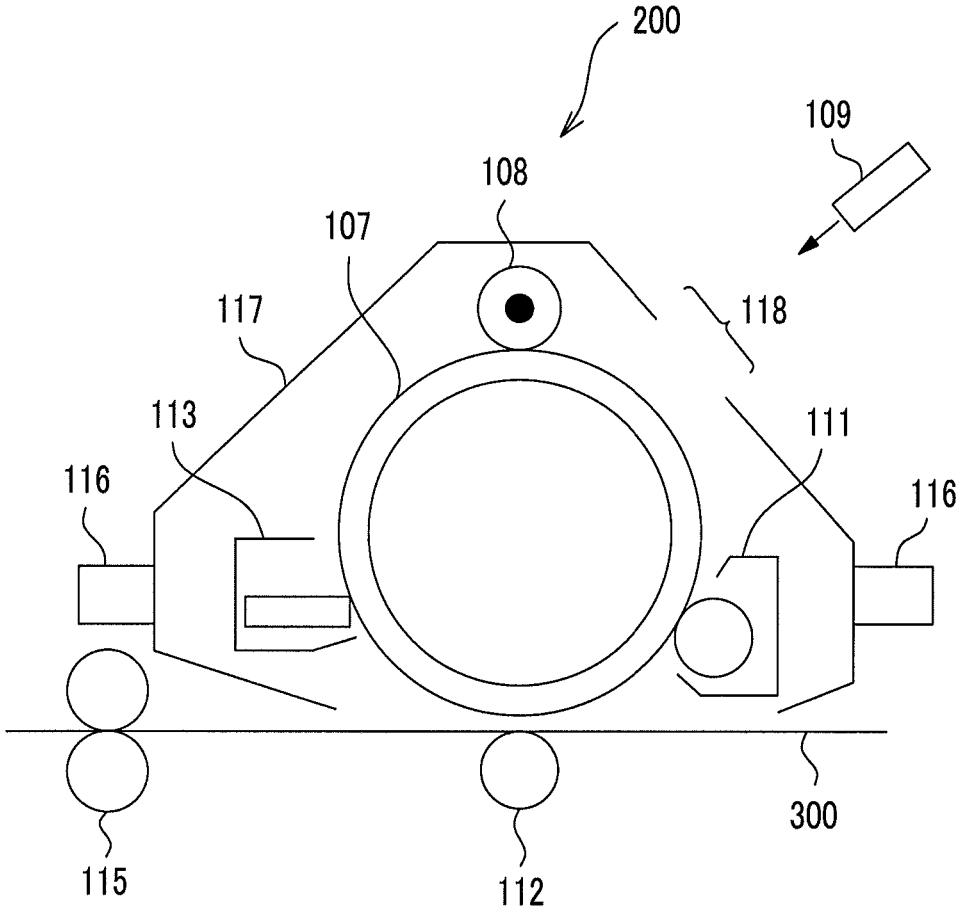
FIG. 2 is a diagram schematically illustrating an example of a configuration of a process cartridge according to an exemplary embodiment of the invention.

FIG. 2 is a diagram schematically illustrating a configuration of the process cartridge according to the exemplary embodiment.

A process cartridge 200 illustrated in FIG. 2 has, for example, a configuration in which a photoreceptor 107 (an example of the image holding member) is integrally combined with a charging roller 108 (an example of the charging unit), a developing device 111 (an example of the developing unit), and a photoreceptor cleaning device 113 (an example of the cleaning unit) that are provided around the photoreceptor 107 by a housing 117 including a mounting rail 116 and an opening 118 for exposure, to form a cartridge.

In FIG. 2, reference numeral 109 represents an exposure device (an example of the electrostatic charge image forming unit), reference numeral 112 represents a transfer device (an example of the transfer unit), reference numeral 115 represents a fixing device (an example of the fixing unit), and reference numeral 300 represents a recording paper (an example of the recording medium).

Next, the toner cartridge according to the exemplary embodiment will be described.

The toner cartridge according to the exemplary embodiment accommodates the toner according to the exemplary embodiment and is detachable from an image forming apparatus. The toner cartridge accommodates replenishing toner that is supplied to a developing unit provided inside an image forming apparatus.

The image forming apparatus illustrated in FIG. 1 has a configuration in which the toner cartridges 8Y, 8M, 8C, and 8K are detachable therefrom, and the developing devices 4Y, 4M, 4C, and 4K are connected to the toner cartridges corresponding to the respective developing devices (colors) through toner supply tubes (not illustrated). In addition, when the amount of toner accommodated in a toner cartridge runs low, this toner cartridge may be replaced with a new one.

EXAMPLES

Hereinafter, the exemplary embodiment will be described in detail using examples but is not limited these examples. In the following description, "part(s)" and "%" represent "part(s) by weight" and "% by weight" unless specified otherwise.

Preparation of Styrene Acrylic Resin Particle Dispersion

Styrene Acrylic Resin Particle Dispersion (1)

Styrene: 320 parts by weight
n-butyl acrylate: 80 parts by weight
Acrylic acid: 12 parts by weight
10-Dodecanethiol: 2 parts by weight A solution in which a mixture of the above-described components is dissolved and a solution in which 6 parts by weight of a nonionic surfactant (NONIPOL 400, manufactured by Sanyo Chemical Industries Ltd.) and 10 parts by weight of an anionic surfactant (NEOGEN SC, manufactured by Dai-Ichi Kogyo Seiyaku Co., Ltd.) are dissolved in 550 parts by weight of ion exchange water are put into a flask, followed by emulsification and dispersion. Next, a solution in which 4 parts by weight of ammonium persulfate is dissolved in 50 parts by weight of ion exchange water is put into the flask while mixing the mixed solution for 10 minutes. After nitrogen substitution, the content is heated to 70° C. by an oil bath while being stirred in the flask, followed by emulsion polymerization for 5 hours. As a result, a resin particle dispersion in which styrene acrylic resin particles (volume average particle size D50v: 210 nm, glass transition temperature Tg: 50° C., weight average molecular weight Mw: 38000) are dispersed is obtained.

Styrene Acrylic Resin Particle Dispersion (2)

A styrene acrylic resin particle dispersion (2) is prepared with the same preparation method as that of the styrene acrylic resin particle dispersion (1), except that the amount of styrene is changed to 254 parts by weight; and the amount of n-butyl acrylate is changed to 156 parts by weight.

Styrene Acrylic Resin Particle Dispersion (3)

A styrene acrylic resin particle dispersion (3) is prepared with the same preparation method as that of the styrene acrylic resin particle dispersion (1), except that the amount of styrene is changed to 238 parts by weight; and the amount of n-butyl acrylate is changed to 172 parts by weight.

Styrene Acrylic Resin Particle Dispersion (4)

A styrene acrylic resin particle dispersion (4) is prepared with the same preparation method as that of the styrene acrylic resin particle dispersion (1), except that n-butyl acrylate is changed to ethyl acrylate.

Styrene Acrylic Resin Particle Dispersion (5)

A styrene acrylic resin particle dispersion (5) is prepared with the same preparation method as that of the styrene acrylic resin particle dispersion (1), except that n-butyl acrylate is changed to tetradecyl acrylate.

Styrene Acrylic Resin Particle Dispersion (6)

A styrene acrylic resin particle dispersion (6) is prepared with the same preparation method as that of the styrene acrylic resin particle dispersion (1), except that n-butyl acrylate is changed to methyl acrylate.

Styrene Acrylic Resin Particle Dispersion (7)

A styrene acrylic resin particle dispersion (7) is prepared with the same preparation method as that of the styrene acrylic resin particle dispersion (1), except that n-butyl acrylate is changed to pentadecyl acrylate.

Preparation of Colorant Particle Dispersion

Preparation of Colorant Particle Dispersion (1)

Cyan Pigment (PB15:3): 70 parts by weight

Nonionic surfactant: 5 parts by weight (NONIPOL 400, manufactured by Sanyo Chemical Industries Ltd.)

Ion exchange water: 220 parts by weight.

The above-described components is mixed, dissolved, and dispersed with a homogenizer (ULTRA TURRAX T50, manufactured by IKA Corporation) for 10 minutes. As a result, a colorant particle dispersion (1) in which colorant (cyan pigment) particles having a volume average particle size D50v of 260 nm are dispersed is prepared.

Preparation of Release Agent Particle Dispersion

Release Agent Particle Dispersion (1)

Paraffin wax: 53 parts by weight (HNP0190, manufactured by Nippon Seiro Co., Ltd., melting temperature: 85° C.)

Cationic surfactant: 6 parts by weight (SANIZOL B50, manufactured by Kao Corporation)

Ion exchange water: 200 parts by weight

The above-described components are heated to 95° C. and dispersed in a round stainless steel flask using a homogenizer (ULTRA TURRAX T50, manufactured by IKA Corporation) for 10 minutes, followed by dispersing with a high pressure homogenizer. As a result, a release agent particle dispersion in which release agent particles having a volume average particle size D50v of 550 nm are dispersed is prepared.

Preparation of Acylglycerol Particle Dispersion

Acylglycerol Particle Dispersion (1)

20 parts by weight of tripalmitin (manufactured by Tokyo Chemical Industry Co., Ltd.; in the formula (AG), $R^1$, $R^2$, and $R^3$=-n-$C_{15}H_{31}$, purity: 98% by weight) as the acylglycerol is dissolved in 100 parts by weight of ethyl acetate to prepare an ethyl acetate solution. Next, 100 parts by weight of the ethyl acetate solution as a dispersed phase and 100 parts by weight of ion exchange water containing 10% by weight of a surfactant (trade name: "NEWCOL", manufactured by Nippon Nyukazai Co., Ltd.) as a dispersed phase are heated to 75° C. and mixed with each other, followed by suspending with a homogenizer until ethyl acetate is completely removed by distillation. As a result, an acylglycerol particle dispersion (1) in which acylglycerol particles having a volume average particle size D50v of 140 nm are dispersed is prepared.

Acylglycerol Particle Dispersion (2)

An acylglycerol particle dispersion (2) is prepared with the same preparation method as that of the acylglycerol particle dispersion (1), except that tripalmitin is changed to tribehenin (in the formula (AG), $R^1$, $R^2$, and $R^3$=-n-$C_{21}H_{43}$, purity: 98% by weight).

Acylglycerol Particle Dispersion (3)

An acylglycerol particle dispersion (3) is prepared with the same preparation method as that of the acylglycerol particle dispersion (1), except that tripalmitin is changed to trimyristin (in the formula (AG), $R^1$, $R^2$, and $R^3$=-n-$C_{13}H_{27}$, purity: 98% by weight).

Acylglycerol Particle Dispersion (4)

An acylglycerol particle dispersion (4) is prepared with the same preparation method as that of the acylglycerol particle dispersion (1), except that tripalmitin is changed to triglycerin (in the formula (AG), $R^1$, $R^2$, and $R^3$=-n-$C_{23}H_{47}$, purity: 98% by weight).

Acylglycerol Particle Dispersion (5)

An acylglycerol particle dispersion (5) is prepared with the same preparation method as that of the acylglycerol particle dispersion (1), except that tripalmitin is changed to tricaprin (in the formula (AG), $R^1$, $R^2$, and $R^3$=-n-$C_9H_{19}$, purity: 98% by weight).

Acylglycerol Particle Dispersion (6)

An acylglycerol particle dispersion (6) is prepared with the same preparation method as that of the acylglycerol particle dispersion (1), except that tripalmitin is changed to monopalmitin (in the formula (AG), $R^1$=-n-$C_{15}H_{31}$, $R^2$ and $R^3$=—H, purity: 98% by weight).

Example 1

Preparation of Toner (1)

Styrene acrylic resin particle dispersion (1): 240 parts by weight

Colorant particle dispersion (1): 20 parts by weight

Release agent particle dispersion (1): 30 parts by weight

Acylglycerol particle dispersion (1): 10 parts by weight

Cationic surfactant (SANIZOL B50, manufactured by Kao Corporation): 1.5 parts by weight The above-described components are mixed in a round stainless steel flask using a homogenizer (ULTRA TURRAX T50, manufactured by IKA Corporation), are dispersed, and are heated to 50° C. in a heating oil bath while stirring the components in the flask. The temperature is held at 45° C. for 20 minutes. At this time, it is confirmed that aggregated particles having an average particle size of about 4.8 μm are formed. Further, 60 parts by weight of the styrene acrylic resin particle dispersion (1) is slowly added to the mixed solution. The temperature of the heating oil bath is heated to 50° C. and is held for 30 minutes. It is confirmed that aggregated particles having an average particle size of about 5.8 μm are formed.

3 parts by weight of an anionic surfactant (NEOGEN SC, manufactured by Dai-Ichi Kogyo Seiyaku Co., Ltd.) is added to the mixed solution, the stainless steel flask is sealed, the mixed solution is heated to 100° C. while stirring the mixed solution with a magnetic seal, and the temperature is held at this temperature for 4 hours. After cooling, a reaction product is separated by filtration and is sufficiently washed with ion exchange water, followed by drying. As a result, toner particles (1) having a shape factor of 120.5 and D50v of 6.4 μm are obtained.

3.3 parts by weight of hydrophobic silica particles (RY50, manufactured by Nippon Aerosil Co., Ltd.) as the external additive are added to 100 parts by weight of the toner particles (1). Next, the toner particles and the external additive are mixed with a Henschel mixer at a peripheral speed of 30 m/s for 3 minutes. Next, the mixture is sieved through a vibration sieve having a mesh size of 45 p.m. As a result, a toner (1) is obtained.

Preparation of Carrier (A)

Ferrite particles (volume average particle size: 50 μm): 100 parts by weight

Toluene: 15 parts by weight

Styrene-methyl methacrylate copolymer (component molar ratio: 90/10): 2 parts by weight Carbon black (R330, manufactured by Cabot Corporation): 0.25 part by weight First, the above-described components other than the ferrite particles are stirred with a stirrer for 10 minutes to prepare a dispersed coating solution. Next, this coating solution and the ferrite particles are put into a vacuum degassing kneader, followed by stirring at 60° C. for 25 minutes. Further, the mixed solution is degassed under reduced pressure while heating the mixed solution, followed by drying. As a result, a carrier A is prepared. In this carrier (A), the shape factor is 120, the true specific gravity is 4.4, the saturation magnetization is 63 emu/g, and the volume resistivity value at the application of an electric field of 1000 V/cm is 1000 Ω·cm. The content of nickel in this carrier is 55 ppm.

Preparation of Developer (1)

8 parts by weight of the toner (1) obtained as above and 92 parts by weight of the carrier (A) are put into a V-blender, are stirred for 20 minutes, and are sieved through a sieve having a mesh size of 105 μm. As a result, a developer (1) is prepared.

Examples 2 to 12

Toners (2) to (12) are prepared with the same preparation method as that of Example 1, except that the kind of the styrene acrylic resin particle dispersion (in the table, shown as "SAc Dispersion"); the kind and the number of parts of the acylglycerol particle dispersion (in the table, shown as "AG Dispersion"); and the number of parts of the external additive are changed as shown in Table 1.

Developers (2) to (12) are prepared with the same preparation method as that of Example 1, except that the obtained toners (2) to (12) are used.

Comparative Examples 1 and 2

Toners (C1) and (C2) are prepared with the same preparation method as that of Example 1, except that the kind of the styrene acrylic resin particle dispersion (in the table, shown as "SAc Dispersion"); the kind and the number of parts of the acylglycerol particle dispersion (in the table, shown as "AG Dispersion"); and the number of parts of the external additive are changed as shown in Table 1. Developers (C1) and (C2) are prepared with the same preparation method as that of Example 1, except that the obtained toners (C1) and (C2) are used.

Comparative Example 3

Combination Example of Styrene Acrylic Resin and Polyester Resin

A toner (C3) is prepared with the same preparation method as that of Example 1, except that the following polyester resin particle dispersion (PE) is used instead of the acylglycerol particle dispersion (1). A developer (C3) is prepared with the same preparation method as that of Example 1, except that the obtained toner (C3) is used.

Preparation of Polyester Resin Particle Dispersion (PE)

Ethylene glycol: 37 parts by weight
Neopentyl glycol: 65 parts by weight
1,9-nonanediol: 32 parts by weight
Terephthalic acid: 96 parts by weight The above-described monomers are put into a flask and are heated to 200° C. over 1 hour. After confirming that the reaction system is stirred, 1.2 parts by weight of dibutyl tin oxide is added thereto. Further, the temperature is increased from the above temperature to 240° over 6 hours while removing produced water by distillation, and a dehydrative condensation reaction is continued at 240° C. for additional 4 hours. As a result, a polyester resin (PE) having an acid value of 9.4 mgKOH/g, a weight average molecular weight of 13000, and a glass transition temperature of 62° C. is obtained.

Next, the polyester resin (PE) in the molten state is transferred into CAVITRON CD1010 (manufactured by Eurotec Ltd.) at a speed of 100 parts by weight per minute. Diluted ammonia water having a concentration of 0.37% which is obtained by diluting a reagent ammonia water with ion exchange water is put into a separately prepared aqueous medium tank. The diluted ammonia water is transferred to the CAVITRON at a speed of 0.1 L per minute along with the polyester resin melt while heating the components to 120° C. with a heat exchanger. By operating the CAVITRON under conditions of a rotating speed of a rotor of 60 Hz and a pressure of 5 kg/cm$^2$, a polyester resin particle dispersion (PE) in which polyester resin particles having a volume average particle size of 160 nm, a solid content of 30%, a glass transition temperature of 62° C., and a weight average molecular weight Mw of 13000 are dispersed is obtained.

Evaluation

The developer obtained in each example is evaluated as follows. The results are shown in Table 1.

Evaluation of Anti-Crease Performance of Image (Crease Evaluation)

The developer obtained in each example is accommodated in a developing device of DocuCentre Color 500-modified machine (manufactured by Fuji Xerox Co., Ltd.; which is modified such that fixing is performed with an external fixing unit where a fixing temperature can be changed). Using this modified machine, a solid image is formed on color paper (J paper, manufactured by Fuji Xerox Co., Ltd.) with an adjusted toner deposition amount of 13.5 g/m$^2$. After being formed, a toner image is fixed using an external fixing unit under conditions of a fixing temperature of 170° C., a fixing nip width (contact width between a fixing roller and a pressure roller) of less than 6.5 mm, and a fixing speed of 180 mm/sec.

Next, the fixed image is stored in an environment of 60° and 50% RH for 20 days, followed by a deterioration acceleration treatment. The center portion of the treated fixed image is folded inward, and a damaged portion of the fixed image is wiped off with tissue paper. The white line width is measured and evaluated based on the following criteria.

G1: The white line width is less than 0.2 mm
G2: The white line width is 0.2 mm or more and less than 0.4 mm
G3: The white line width is from 0.4 mm to 0.8 mm
G4: The white line width is more than 0.8 mm Evaluation of Fixing Property The fixing property of the developer obtained in each example is evaluated as follows.

The developer obtained in each example is accommodated in a developing device of DocuCentre Color 500-modified machine (manufactured by Fuji Xerox Co., Ltd.; which is modified such that fixing is performed with an external fixing unit where a fixing temperature can be changed). Using this modified machine, a solid image is formed on color paper (J paper, manufactured by Fuji Xerox Co., Ltd.) with an adjusted toner deposition amount of 13.5 g/m$^2$. After a toner image is formed, using an external fixing unit in which fixing rollers are set to heat the toner image from 80° C. to 200° C., the toner image is fixed at temperature increasing by 10° C. increments. The obtained fixing image surface is folded in a valley shape, the image peeling of a folded portion is observed, and a temperature at which the image peeling does not occur is evaluated. The evaluation criteria are as follows.

G1: Fixing is possible in a range from 130° C. to 150° C.
G2: Fixing is possible in a range higher than 150° C. and lower than or equal to 160° C.
G3: Fixing is possible in a range higher than 160° C. and lower than or equal to 170° C.
G4: Fixing is possible only in a range higher than 170° C.

Evaluation of Fluidity

The fluidity of the toner of the developer obtained in each example is evaluated as follows.

The developer obtained in each example is mounted to a DocuPrint 1100 CF-modified machine (manufactured by Fuji Xerox Co., Ltd.), and blank images are continuously printed for 200 minutes in an environment of 32° C. and 90% RH without replenishing toner. After completion of printing, the developer state in a developing device is observed by visual inspection. The evaluation criteria are as follows.

G1: The developer maintains its initial state, and there is no problem in fluidity G2: The developer is slightly aggregated, but aggregates are easily loosened by operating the developing device and there is no problem G3: Aggregates having a size of about several millimeters remain even after the operation of the developing device, and there is an effect on an image G4: Aggregates having a size of about several centimeters are generated, and it is difficult to operate the developing device Hereinafter, the details of each example and the evaluation results thereof are shown in Table 1.

TABLE 1

| | SAc Dispersion | | | AG Dispersion | | | | External Additive | | Evaluation | | |
|---|---|---|---|---|---|---|---|---|---|---|---|---|
| | No. | Ratio of Styrene (% by Weight) | Carbon Number of Alkyl Group in (Meth)acrylic Acid Ester | No. | % by Weight | $R^1$, $R^2$, $R^3$ in Formula (AG) | Purity of Acylglycerol (% by Weight) | Part(s) | Coverage (%) | Anti-Crease Performance | Fixing Property | Fluidity |
| Example 1 | (1) | 80 | 4 | (1) | 10 | $R^1$, $R^2$, $R^3$ = -n-$C_{15}H_{31}$ | 98 | 3.3 | 80 | G1 | G1 | G1 |
| Example 2 | (1) | 80 | 4 | (2) | 10 | $R^1$, $R^2$, $R^3$ = -n-$C_{21}H_{43}$ | 98 | 3.3 | 80 | G1 | G1 | G1 |
| Example 3 | (1) | 80 | 4 | (3) | 10 | $R^1$, $R^2$, $R^3$ = -n-$C_{11}H_{23}$ | 98 | 3.3 | 80 | G1 | G1 | G1 |
| Example 4 | (1) | 80 | 4 | (6) | 10 | $R^1$= -n-$C_{15}H_{31}$ $R^2$, $R^3$ = —H | 98 | 3.3 | 80 | G1 | G1 | G1 |
| Example 5 | (1) | 80 | 4 | (1) | 10 | $R^1$, $R^2$, $R^3$ = -n-$C_{15}H_{31}$ | 98 | 2.55 | 62 | G1 | G1 | G1 |
| Example 6 | (1) | 80 | 4 | (1) | 10 | $R^1$, $R^2$, $R^3$ = -n-$C_{15}H_{31}$ | 98 | 2.35 | 58 | G1 | G1 | G2 |
| Example 7 | (2) | 62 | 4 | (1) | 10 | $R^1$, $R^2$, $R^3$ = -n-$C_{15}H_{31}$ | 98 | 3.3 | 80 | G1 | G1 | G1 |
| Example 8 | (3) | 58 | 4 | (1) | 10 | $R^1$, $R^2$, $R^3$ = -n-$C_{15}H_{31}$ | 98 | 3.3 | 80 | G1 | G1 | G2 |
| Example 9 | (4) | 80 | 2 | (1) | 10 | $R^1$, $R^2$, $R^3$ = -n-$C_{15}H_{31}$ | 98 | 3.3 | 80 | G1 | G1 | G1 |
| Example 10 | (5) | 80 | 14 | (1) | 10 | $R^1$, $R^2$, $R^3$ = -n-$C_{15}H_{31}$ | 98 | 3.3 | 80 | G1 | G1 | G1 |
| Example 11 | (6) | 80 | 1 | (1) | 10 | $R^1$, $R^2$, $R^3$ = -n-$C_{15}H_{31}$ | 98 | 3.3 | 80 | G2 | G1 | G2 |
| Example 12 | (7) | 80 | 15 | (1) | 10 | $R^1$, $R^2$, $R^3$ = -n-$C_{15}H_{31}$ | 98 | 3.3 | 80 | G2 | G2 | G1 |
| Comparative Example 1 | (1) | 80 | 4 | (4) | 10 | $R^1$, $R^2$, $R^3$= -n-$C_{23}H_{47}$ | 98 | 3.3 | 80 | G3 | G3 | G2 |
| Comparative Example 2 | (1) | 80 | 4 | (5) | 10 | $R^1$, $R^2$, $R^3$ = -n-$C_9H_{19}$ | 98 | 3.3 | 80 | G3 | G2 | G3 |
| Comparative Example 3 | (1) | 80 | 4 | Polyester Resin Particle Dispersion (PE) Used | | | | 3.3 | 80 | G4 | G4 | G3 |

It can be seen from the results that, when Examples are compared to Comparative Examples, the evaluation results of the anti-crease performance of an image are superior in Examples. As a result, it can be seen that, when Examples are compared to Comparative Examples, the anti-crease performance of an image is maintained for a long period of time in Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a binder resin containing a styrene acrylic resin;

toner particles containing an acylglycerol; and an external additive, wherein:

at least one of hydroxyl groups in the acylglycerol is esterified with an alkyl monocarboxylic acid that contains a substituted or unsubstituted alkyl group having from 12 to 22 carbon atoms;

a content of a portion esterified with the alkyl monocarboxylic acid that contains the alkyl group having the same carbon number is 95% by weight or greater with respect to the total weight of the acylglycerol; and a ratio of a styrene component of the styrene acrylic resin to all polymerizable components in the styrene acrylic resin is from 70% by weight to 85% by weight.

2. The electrostatic charge image developing toner according to claim 1, wherein the acylglycerol is represented by the following formula (AG):

(AG)

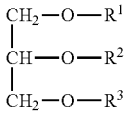

wherein in the formula (AG), $R^1$, $R^2$, and $R^3$ each independently represent a hydrogen atom or —C(=O)—R, R represents a substituted or unsubstituted alkyl group having from 12 to 22 carbon atoms, and at least one of $R^1$, $R^2$, and $R^3$ represents —C(=O)—R.

3. The electrostatic charge image developing toner according to claim 1, wherein the styrene acrylic resin is a copolymer obtained by polymerization of at least a styrene and a (meth)acrylic acid ester that contains an alkyl group having from 2 to 14 carbon atoms.

4. The electrostatic charge image developing toner according to claim 1, wherein a glass transition temperature (Tg) of the styrene acrylic resin is from 45° C. to 80° C.

5. The electrostatic charge image developing toner according to claim 4, wherein the glass transition temperature (Tg) of the styrene acrylic resin is from 45° C. to 65° C.

6. The electrostatic charge image developing toner according to claim 1, wherein a weight average molecular weight (Mw) of the styrene acrylic resin is from 5,000 to 700,000.

7. The electrostatic charge image developing toner according to claim 1, wherein a molecular weight distribution Mw/Mn of the styrene acrylic resin is from 1.0 to 100.

8. The electrostatic charge image developing toner according to claim 1, wherein a content of the styrene acrylic resin is 60% by weight or greater with respect to the total weight of the binder resin.

9. The electrostatic charge image developing toner according to claim 1, wherein a content of the binder resin is from 40% by weight to 95% by weight with respect to the total weight of the toner particles.

10. The electrostatic charge image developing toner according to claim 1, wherein a content of the acylglycerol is from 2% by weight to 30% by weight with respect to the total weight of the toner particles.

11. The electrostatic charge image developing toner according to claim 1, wherein a coverage of the external additive to the toner particles is 60% or higher.

12. The electrostatic charge image developing toner according to claim 1, wherein a volume average particle size (D50v) of the toner particles is from 2 μm to 15 μm.

13. The electrostatic charge image developing toner according to claim 1, wherein a shape factor SF1 of the toner particles is from 110 to 150.

14. The electrostatic charge image developing toner according to claim 1, further comprising a release agent, wherein a content of the release agent is from 1% by weight to 20% by weight with respect to the total weight of the toner particles.

15. The electrostatic charge image developing toner according to claim 14, wherein a melting temperature of the release agent is from 50° C. to 110° C.

16. An electrostatic charge image developer comprising the electrostatic charge image developing toner according to claim 1.

17. The electrostatic charge image developer according to claim 16, wherein the developer contains a magnetic oxide and 10 ppm to 150 ppm of nickel with respect to the total amount of the magnetic oxide.

18. A toner cartridge which accommodates the electrostatic charge image developing toner according to claim 1 and is detachable from an image forming apparatus.

* * * * *